US005113777A

United States Patent [19]

Kobayashi

[11] Patent Number: 5,113,777

[45] Date of Patent: May 19, 1992

[54] STEERING DEVICE FOR SMALL JET BOAT

[75] Inventor: Noboru Kobayashi, Iwata, Japan

[73] Assignee: Yamaha Hatsudoki Kabushiki Kaisha, Iwata, Japan

[21] Appl. No.: 695,102

[22] Filed: May 3, 1991

Related U.S. Application Data

[63] Continuation of Ser. No. 452,725, Dec. 18, 1989, abandoned.

[30] Foreign Application Priority Data

Dec. 19, 1988 [JP] Japan ..... 63-321593

[51] Int. Cl.[5] ..... B63H 25/00

[52] U.S. Cl. ..... 114/144 R; 440/42; 114/270

[58] Field of Search ..... 114/220, 144 R, 163, 114/283, 284, 152, 162; 440/38, 42

[56] References Cited

U.S. PATENT DOCUMENTS

| | | | |
|---|---|---|---|
| 3,158,129 | 11/1964 | Mauer | 114/270 |
| 3,280,786 | 10/1966 | Rowell | 440/38 |
| 3,483,844 | 12/1969 | Trautwein | 114/270 |
| 3,948,206 | 4/1976 | Tyler | 114/270 |

*Primary Examiner*—Edwin L. Swinehart
*Attorney, Agent, or Firm*—Ernest A. Beutler

[57] ABSTRACT

A small jet propelled watercraft having a jet propulsion unit with a steering nozzle and further including a steering ski at the front of the watercraft for providing lift to the hull and also for providing a steering effect. The steering nozzle and steering ski are interconnected so that they are steered in opposite directions so as to provide a crisper steering and steering even at low speeds or when coasting.

5 Claims, 2 Drawing Sheets

STEERING DEVICE FOR SMALL JET BOAT

This a continuation of U.S. application Ser. No. 452,725, filed Dec. 18, 1989, and now abandoned.

BACKGROUND OF THE INVENTION

This invention relates to an improved steering device for a small jet boat and more particularly to an improved hull and steering arrangement for a small watercraft of the jet propelled type.

A type of watercraft that is enjoying substantial popularity is the small jet propelled type of watercraft that is designed to be operated by a single rider who sits on the watercraft in a generally straddle fashion. Conventionally, this type of watercraft is provided with a hull having a rear positioned tunnel in which a jet propulsion unit is positioned for powering the watercraft. The watercraft is normally steered by pivotal movement of the discharge nozzle of the jet propulsion unit. Although this type of watercraft has high utility, under some circumstances the steering system provided by the-jet propulsion unit is not as responsive as might be desired. Although the steering system is acceptable at high speeds, it may not be as responsive as desired at low speeds and, of course, no steering effect is possible when the power is shut off and the watercraft is coasting.

In addition to these possible steering disadvantages, this type of watercraft is, at times, difficult to beach when operating the watercraft in areas where dock facilities are not available. There has, therefore, been proposed another type of small watercraft which is also powered by a jet propulsion unit but which, rather than floating on the water with its hull, is provided with ski type arrangements for suspending the watercraft above the water and for its steering. This type of watercraft has several disadvantages.

Specifically, the rider tends to be positioned at an elevated location above the water. This can give rise to difficulties in stability. Furthermore, the provision of only a steering ski for steering the watercraft can give rise to significant drag and other steering defects.

It is, therefore, a principal object of this invention to provide an improved steering arrangement for a small jet propelled boat.

It is a further object of this invention to provide an improved hull and steering arrangement for a jet propelled boat that will avoid the disadvantages of the prior art, as aforenoted.

SUMMARY OF THE INVENTION

A first feature of this invention is adapted to be embodied in a small jet propelled watercraft comprising a hull designed to be submerged in the body of water in which the watercraft is operating and which carries an internal combustion engine A jet propulsion unit is carried by the hull in a tunnel at the rear end thereof and is driven by the engine This jet propulsion unit is at least partially submerged during operation. In accordance with this feature of the invention, a steering ski is supported for dirigible movement at the front of the hull and is configured to provide a lift for the front of the hull as well as a steering effect.

Another feature of this invention is adapted to be embodied in a small jet propelled watercraft comprising a hull designed to be submerged in the body of water in which the watercraft is operating and which carries an internal combustion engine. A jet propulsion unit is carried by the hull in a tunnel at the rear end thereof and is driven by the engine and has a steerable discharge nozzle. In accordance with this feature of the invention, a steering ski is supported for dirigible movement at the front of the hull and is steered with the discharge nozzle and is submerged at all times to provide a steering effect even when the discharge nozzle provides none.

DETAILED DESCRIPTION OF THE PREFERRED EMBODIMENTS OF THE INVENTION

Figure 1:
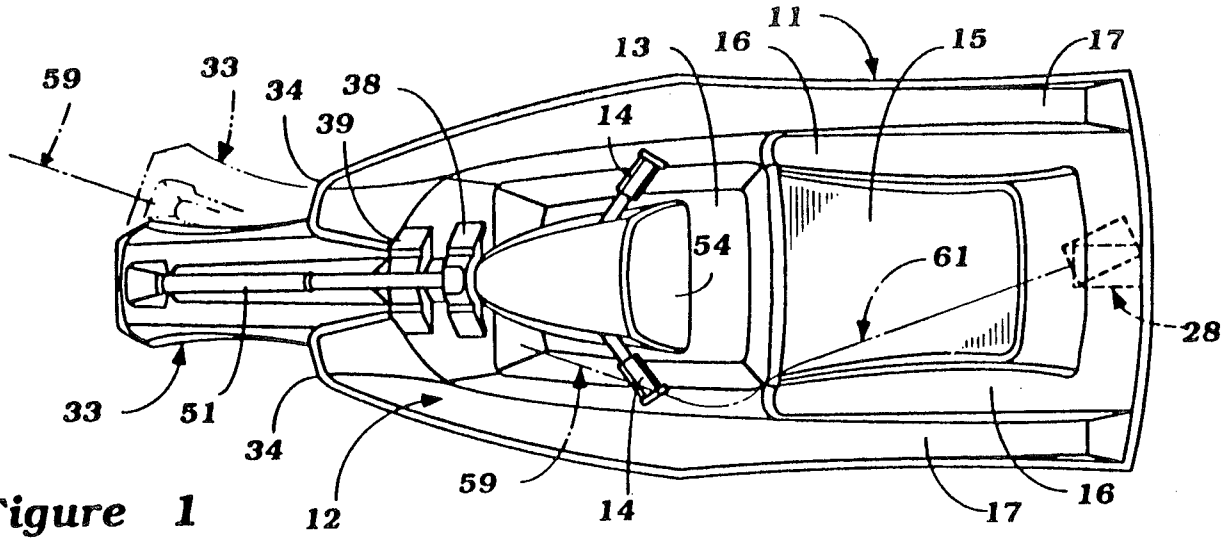
FIG. 1 is a top plan vie w of a small watercraft constructed in accordance with an embodiment of the invention.
Figure 2:
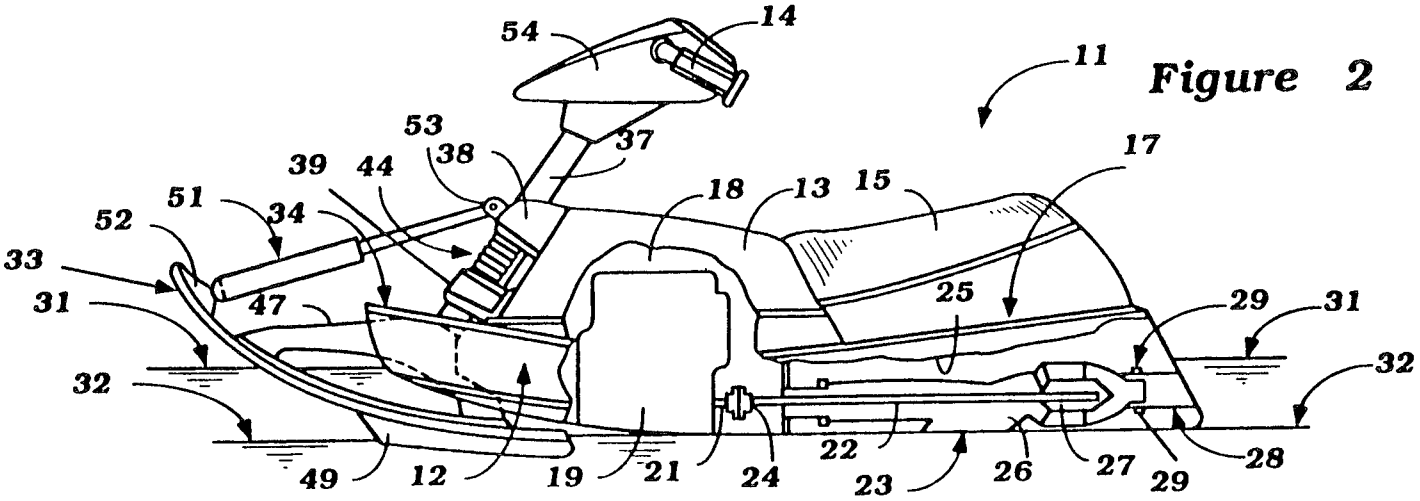
FIG. 2 is a side elevational view of the watercraft, with a portion broken away, and shows the watercraft when operating at slow speeds and when operating at maximum speed and the relative water level under each running condition.

Referring first generally to FIGS. 1 and 2, a small jet propelled watercraft constructed in accordance with an embodiment of the invention is identified generally by the reference numeral 11. The small watercraft 11 is comprised of a displacement hull assembly, indicated generally by the reference numeral 12 and which may be formed from a molded fiberglass reinforced resin or similar material well known in this art. The hull 12 has a raised central bridge portion 13 on which a handlebar assembly 14 is supported for steering of the watercraft in a manner to be described. Positioned rearwardly of the bridge 13 is a rider's area that is comprised of a rider's seat 15 upon which a rider is designed to be accommodated seated in a straddle fashion. In such a condition, the rider may place his feet in depressed foot areas 16 that are disposed between the seat 15 and raised gunnels 17 formed at the sides of the rider's area by the hull 12. It should be noted that the rider's area is open through the rear of the transom so that water which may enter can easily be drained therefrom. This open area also affords an access area through which a rider may enter the vehicle from the body of water in which the watercraft is operating.

The hull 12 defines an engine compartment 18 that is positioned generally beneath the bridge 13 and in which an internal combustion engine 19 of any known type may be positioned. The engine 19 has an output shaft 21 that is coupled to an input shaft 22 of a jet propulsion unit, indicated generally by the reference numeral 23 by means of an elastic coupling 24.

The jet propulsion unit 23 may be of any known type and is positioned within a tunnel area 25 that is positioned beneath the seat 15. The jet propulsion unit 23 has a downwardly and forwardly facing water inlet 26 into which water is drawn from the body of water in which the watercraft is operating by an impeller 27 that is coupled to the input shaft 22. This water is then discharged back into the body of water in which the watercraft is operating through a steering discharge nozzle 28 that is pivotally connected to the main housing of the impeller by means of a pair of vertically extending pivots 29. The steering nozzle 28 is controlled by the handlebar assembly 14 in a manner to be described.

It should be noted that FIG. 2 illustrates the ride level 31 assumed by the watercraft 11 when travelling at slow speeds. The water level at high speeds is indicated by the line 32. It should be noted that at slow speeds when the watercraft is operating at the more submerged condition, the jet propulsion unit will be generating relatively low thrust. Hence the steering operation will not be as crisp or precise as may be desired. Also, the hull 12, with a conventional type of watercraft of this general nature, must also provide a full lift to raise the hull to the high speed condition. In accordance with the invention, there is provided a front ski assembly, indicated generally by the reference numeral 33 which is coupled to the handlebar assembly 14 in a manner to be described for steering movement. In addition, the front ski assembly 33 is configured so as to provide additional lift to the watercraft so as to assist it in becoming on plane condition and also to assist when beaching the watercraft.

It should be noted that the forward portion of the hull 12 is provided with a pair of spaced apart bow sections 34 that define a gap therebetween in which the steering mechanism for the ski assembly 33 is positioned.

Figure 3:
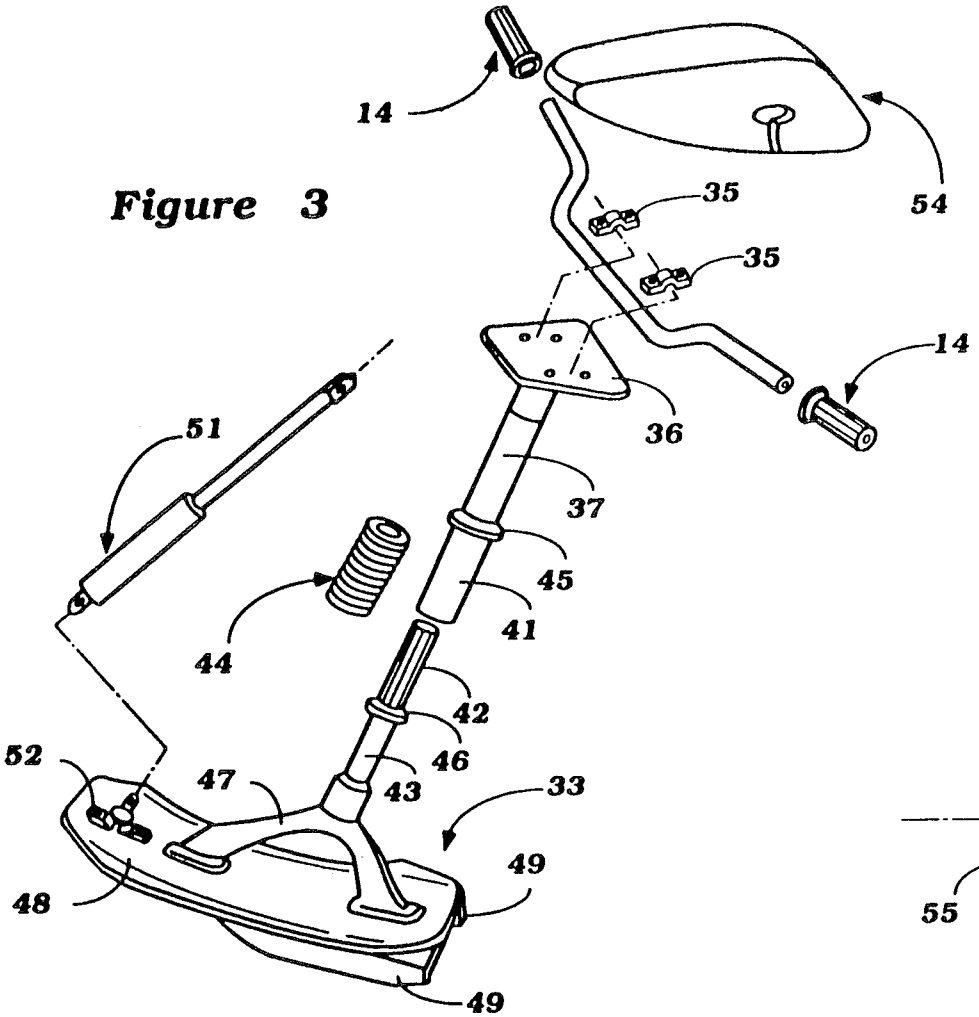
FIG. 3 is a partially exploded perspective view showing the construction of the steering front ski.

Referring now in detail to FIG. 3 in addition to FIGS. 1 and 2, it will be noted that the handlebar assembly 14 is affixed by means of a pair of brackets 35 to a plate 36 formed at the upper end of a steering shaft 37. The steering shaft 37 is, in turn, journaled for steering movement relative to the hull 12 in the aforedescribed recesses by means of a pair of supporting brackets 38 and 39.

The lower end of the steering shaft 37 is formed with an enlarged portion 41 that defines a splined opening in which a male splined portion 42 of a ski shaft 43 is received. As a result of this connection, the ski shaft 43 will rotate for steering movement with the steering shaft 37 but vertical movement between these two components is permitted. A coil compression spring 44 is loaded between a lug 45 formed on the steering shaft 37 and a lug 46 formed on the ski shaft 43 so as to yieldably resist vertical movement between the ski assembly 33 and the steering shaft 37.

At the lower end of the ski shaft 43 there is provided a connecting bracket 47 that is affixed to a planar upper surface 48 of the ski assembly 33. It should be noted that the ski assembly 33 has a generally curved configuration as best shown in FIG. 2 so as to provide the desired lift. In addition, there are provided a pair of depending runners 49 that will assist in the steering operation of the ski assembly 33.

An air strut 51 is interposed between the ski assembly 33 and the hull 12 so as to provide controlled movement of the ski 33 vertically relative to the steering shaft 37. The strut 51 as a pivotal connection to a boss 52 at the forward portion of the ski 33 and a pivotal connection at 53 to the upper bracket 38 for the steering shaft 37.

A cowling member 54 is affixed over the central portion of the handlebar assembly 14 in a suitable manner..and may contain some of the controls for the watercraft. In addition, the cowling 54 is configured so as to permit a rider to lean on it to accommodate certain running conditions.

Figure 4:
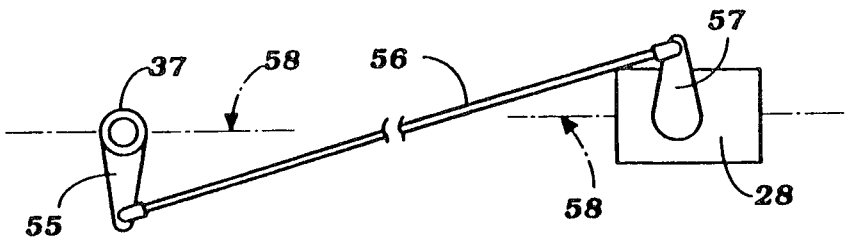
FIG. 4 is a schematic top plan view showing the interrelationship between the steering mechanism of the front ski and that of the steering nozzle of the jet propulsion unit.

The mechanism for interconnecting the handlebar assembly 14 and steering shaft 37 to the steering nozzle 28 for steering it is shown in most detail in FIG. 4. This mechanism is operative so as to effect steering of the nozzle 28 in the opposite sense from the ski 33 so as to provide a sharper turning circle and also to provide steering even when traveling at low speeds or coasting. To this end, there is provided a steering arm 55 that is affixed to the steering shaft 37 and, in the straight ahead position, extends to the left as seen in FIG. 4. A connecting link 56 interconnects the steering shaft steering arm 55 to a steering nozzle steering arm 57 which extends to the right of a center line 58 of the hull 12. As a result, the link 56 and steering arms 55 and 57 effect the opposite pivotal movements as best shown in FIG. 1. In order to effect a right hand turn as shown in this figure, the handlebar assembly 14 will be rotated in a clockwise direction and the ski 33 will also be rotated in this direction to assume a line of attack indicated by the phantom line 59. On the other hand, the steering nozzle 28 will be rotated in a counterclockwise direction by the mechanism described so as to assume a steering angle as shown by the phantom line 61. As a result, these two steering devices will act together to provide very crisp steering action. In addition, at low speeds the steering ski 33 will provide very good steering effect even though the nozzle 28 is developing only small or no forward thrust.

Figure 5:
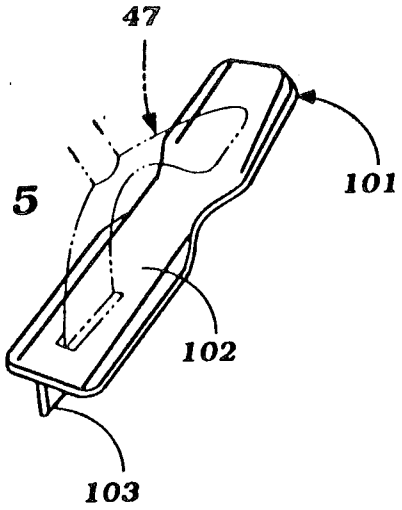
FIG. 5 is a partial perspective view showing a front ski constructed in accordance with another embodiment of the invention.

In the embodiment thus far described, the steering ski 33 has been provided with a pair of steering runners 49. A steering ski constructed in accordance with another embodiment of the invention is shown in FIG. 5 and is identified by the reference numeral 101. The ski 101 has a generally planar upper portion 102 that is affixed to the bracket 47 and one depending rudder portion 03 for providing the desired steering effect. Of course, various other forms of steering ski arrangements may be employed and other changes and modifications may be made without departing from the spirit and scope of the invention, as defined by the appended claims.

I claim:

1. A small jet propelled watercraft comprising a hull having a generally flat undersurface, an internal combustion engine carried by said hull, a jet propulsion unit carried by said hull and recessed into said hull above said undersurface at a rear end thereof and positioned rearwardly of and driven by said engine, said jet propulsion unit being at least partially submerged during watercraft operation and a steering ski having a steering rudder on the lower portion thereof supported for steering movement at a front of said hull and extending rearwardly beneath a forward portion of said hull, said steering ski being configured to provide a lift for the front of said hull while the rear of said hull undersurface rises in the water as the speed of the watercraft increases, said steering ski and said hull being configured and arranged so that said steering ski is substantially submerged when said watercraft is stationary in the body of water or traveling at low speeds and wherein said steering ski is substantially raised in the water so that substantially only said steering rudder is submerged when traveling at high speeds.

2. A small jet propelled watercraft as set forth in claim 1 wherein the steering ski is supported for suspension movement relative to the hull.

3. A small jet propelled watercraft as set forth in claim 1 wherein the jet propulsion unit further includes a steering nozzle operatively connected to the steering ski for providing a further steering effect for the watercraft.

4. A small jet propelled watercraft as set forth in claim 3 wherein the operative connection to the steering nozzle and steering ski is effective to rotate the steering nozzle in an opposite direction from the steering ski.

5. A small jet propelled watercraft as set forth in claim 4 wherein the steering ski is supported for suspension movement relative to the hull.

* * * * *